US005199712A

United States Patent [19]

Hoyle, Jr. et al.

[11] Patent Number: 5,199,712

[45] Date of Patent: Apr. 6, 1993

[54] GOLF SWING TRAINING APPARATUS

[76] Inventors: Fred L. Hoyle, Jr., 9836 Meadow Wood Dr., Pickerington, Ohio 43147; Richard W. Holstein, 1845 Progress Ave., Columbus, Ohio 43207; Patrick S. Phillips, 495 S. Third St., Columbus, Ohio 43215

[21] Appl. No.: 839,477

[22] Filed: Feb. 19, 1992

[51] Int. Cl.[5] ..... A63B 69/36

[52] U.S. Cl. ..... 273/187.2; 273/190 A; 33/262; 33/366; 2/199; 116/222; 116/307

[58] Field of Search ..... 273/187.2, 190 R, 190 A, 273/190 B, 186.2; 33/366, 262; 2/209.1, 196, 185 R, 199; 116/222, 306, 307

[56] References Cited

U.S. PATENT DOCUMENTS

| | | | |
|---|---|---|---|
| 1,569,766 | 8/1924 | McArdle | 273/190 B |
| 1,668,023 | 3/1928 | Murphy | 273/190 B |
| 4,098,509 | 4/1978 | Van Krevelen | 273/187.2 |
| 4,560,166 | 12/1985 | Emerson | 273/187.2 |
| 4,789,160 | 12/1988 | Dollar et al. | 273/186.2 |
| 4,790,539 | 12/1988 | Clark | 273/190 B |
| 4,911,441 | 3/1990 | Brunner | 273/186.2 |
| 5,108,104 | 4/1992 | Johnson | 273/187.2 |
| 5,150,104 | 9/1992 | Thomas et al. | 33/266 X |

*Primary Examiner*—George J. Marlo
*Attorney, Agent, or Firm*—Biebel & French

[57] ABSTRACT

A golf swing training apparatus is disclosed having a housing, a circuit board, a buzzer, a battery, an on/off switch, and a pair of mercury switches. The housing has a clip member extending therefrom with the housing being capable of attachment in a preferred and alternate embodiment in conjunction with an item of headgear worn by a golfer for indicating undesirable movement of the golfer's head while executing a golf club swing.

7 Claims, 4 Drawing Sheets

GOLF SWING TRAINING APPARATUS

BACKGROUND OF THE INVENTION

This invention relates to a golf training apparatus, and more particularly to a golf training apparatus involving head gear.

It is a common practice among golfers to use training devices in order to perfect their stance and/or their swing. Some of these devices are part of equipment available for use at driving ranges or on the golf course, and some are portable units which are owned by golfers and are used in small areas such as a home or an office.

It is well known to those persons who have tried to play golf that they must learn to address, or strike, a golf ball properly, so that it may be accurately driven in a straight direction. To a novice, it seems perfectly natural to turn the head along with the body when swinging the club to strike the ball. However, the experienced player knows that he must hold his head steady and keep his eyes on the ball standing in front of him throughout the full swing. Head movement will cause the golfer to improperly move other portions of the body, thus preventing the golf club from making the proper contact with the golf ball.

Considerable practice is generally needed in order to acquire a proper swing. Even a veteran player may need occasional reminders or retraining with respect to movement of one's head during the golf swing. Undesirable head movement is often difficult to detect. The golfer has so many aspects of body control on his mind during the swing, that it is often difficult to detect improper head movement, much less overcome such movement.

Many attempts have been made to enhance the control of head movement through a variety of means. For example, there are practice discs which can be attached to a wall, against which disc the golfer places his head in order to learn to swing without turning the head. Additionally, there are a number of visual signalling devices such as are disclosed in U.S. Pat. Nos. 4,303,244; 3,729,200; 2,461,826; and 2,077,318. Additionally, there are devices which disclose audible signalling devices such as U.S. Pat. Nos. 4,098,509; 4,560,166; 1,569,766; and 1,668,023.

In Emerson, U.S. Pat. No. 4,560,166, a relatively complex device is shown which features among other components a microphone and an inhibitor switch, which cooperate to sound a audible signal. Similarly, Van Krevelen, U.S. Pat. No. 4,098,509 discloses a visor having a bell secured thereto such that any movement of the visor will cause the ringing of the bell. Murphy, U.S. Pat. No. 1,668,023, discloses a visor having a cord clipped thereto. At the opposite end of the cord is a magnet which is attached to the striker of a gong. Excessive head movement pulls on the cord which in turn raises the magnet. When the movement becomes too excessive, the magnet detaches from the striker thereby sounding the gong. Finally, McArdle, U.S. Pat. No. 1,569,766, discloses a golf practice apparatus and head movement detector wherein a cap has a line secured thereto, as well as to a sound box positioned on a tripod. Excessive head movement causes the ratchet within the sound box to emit an audible noise.

Another golf swing training apparatus is disclosed in Clark, U.S. Pat. No. 4,790,539, wherein a head piece having a visor to which a bracket is mounted is disclosed. A retaining pin is secured to the bracket by a cord, with the pin thereafter being inserted in the ground to result in a fixed distance between the inserted pin and the bracket on the visor such that any unnecessary head movement will be more readily appreciated by the wearer of the head piece.

Other golf training devices have also been proposed, however, none of them have disclosed a relatively simple yet effective device for correcting improper head movement. Many of the above discussed devices are awkward or complex mechanisms which are not practical for actual use on a golf course.

It is thus apparent that the need exists for an improved golf swing training apparatus or the like which provides a simple, yet effective means for controlling head movement during a golf swing.

SUMMARY OF THE INVENTION

The problems associated with prior golf swing training devices are overcome in accordance with the present invention by the providing of an apparatus including a housing with the housing both a lid and a case bottom. Inside the housing is secured to a circuit board, to which a buzzer, battery, on/off switch and a pair of mercury switches are affixed. When the device is on, the completion of the circuit by virtue of the mercury switch being closed when the tilted due to unnecessary head movement results in the buzzer emitting an audible sound.

The lid of the housing is preferably hinged to the housing. Additionally, the housing has a clip member extending therefrom. The clip member may be secured to the headgear in an alternative embodiment of the invention.

The on/off switch includes a stationary portion as well as a removable portion. While the stationary portion is secured to the circuit board the removable portion is detachable from said stationary portion while remaining connected thereto by a wire.

The primary object of this invention is to provide for a golf swing training apparatus which will help to perfect a golfer's swing by restraining head during the swing and to provide such a device that is simple to manufacture and to use.

Yet another objective of this invention is to provide for a golf swing training apparatus which may be actually be used at a driving range on a golf course. Important aspects of this objective are that the device be lightweight, easily transportable, and visually unobtrusive. Another aspect of this objective is the presence of an adjustable mercury switch.

Other objects and advantages of the invention will be apparent from the following description, the accompanying drawings, and the appended claims.

DETAILED DESCRIPTION OF THE INVENTION

Figure 1:
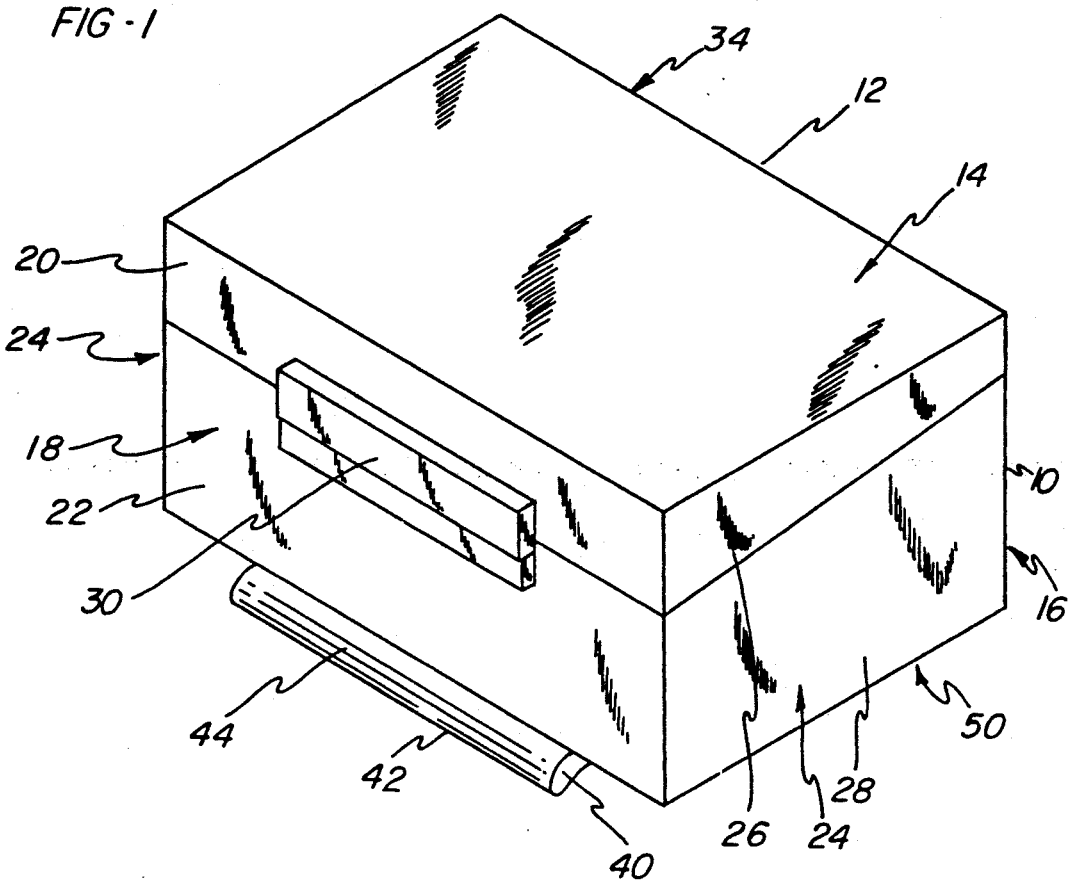
FIG. 1 is a perspective view of a golf swing training apparatus in accordance with the present invention.

Having reference to the drawings, attention first is directed to FIG. 1 which discloses a golf swing training apparatus embodying this invention and designated generally by the numeral 10. The golf aid 10 is shown as comprising a housing 12 having a lid 14 and case bottom 16. The box-shaped housing 12 features a front face 18 having a front top portion 20 associated with lid 14 and a front bottom portion 22 associated with the case bottom 16.

Figure 2:
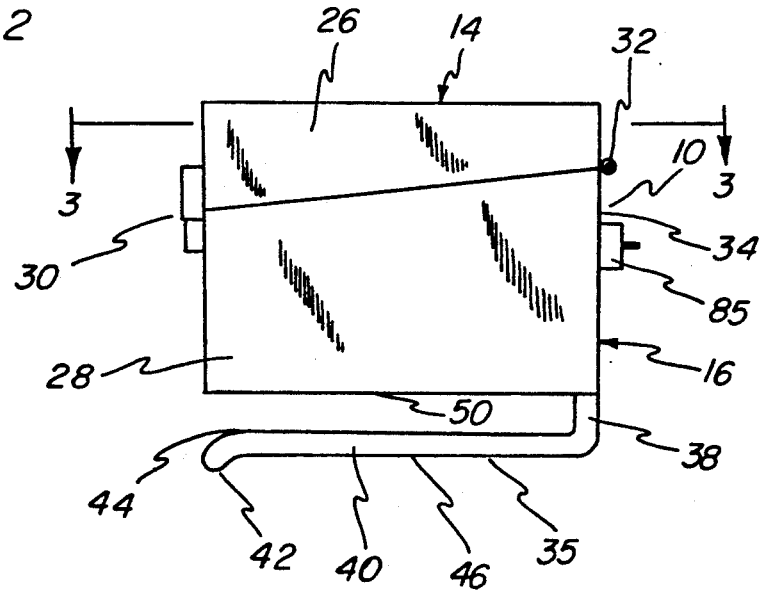
FIG. 2 is a side elevational view of the golf swing training apparatus of the present invention.

Additionally, as can be seen in a comparison of FIGS. 1 and 2, the housing 12 also has a pair of sides 24 each of which having a side top portion 26 as a component of the lid 14 and a side bottom portion 28 as a component of the case bottom 16.

Along the front face 18 of the housing 12 is a cooperative fastening means 30 which serves to secure the lid 14 to the case bottom 16. Although the fastener 30 shown in the drawing figures is one which depends on frictional engagement, other types of fasteners such as mechanically engaging or magnetic could be utilized. A hinge 32 extends along the rear face 34 of the housing 12. The hinge 32 serves as a means for retaining the lid 14 to the case bottom 16. Preferably the housing is formed of plastic, which could be molded into the configuration shown.

Figure 4:
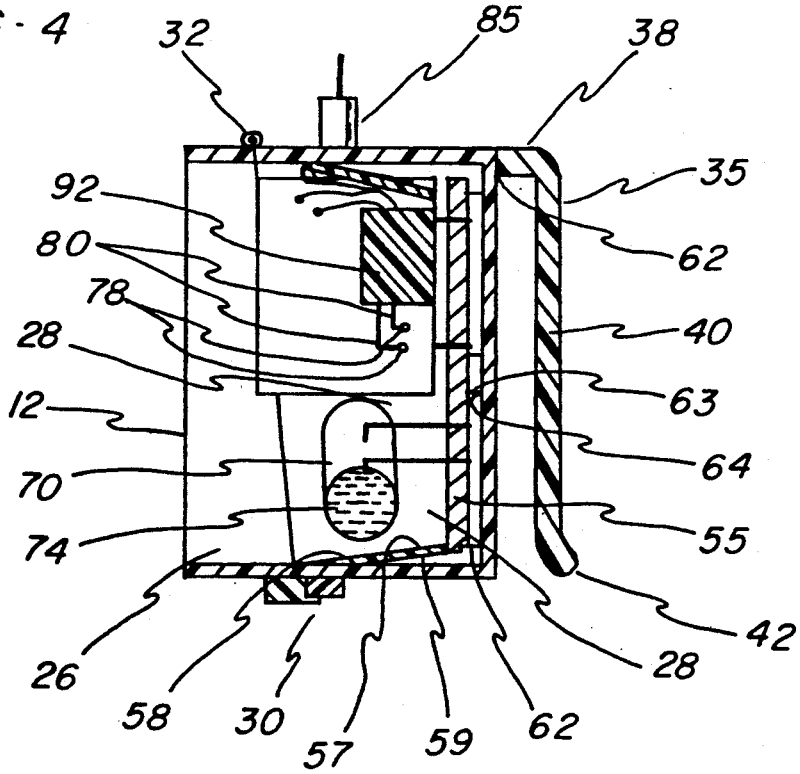
FIG. 4 is a vertical sectional view taken along 4—4 of FIG. 3.

As can be seen through a comparison of FIGS. 1, 2, and 4, the golf swing training apparatus 10 of this invention also comprises a clip 35, with the housing having the clip extending therefrom. The clip 35 is preferably somewhat resilient and flexible and is comprised of a clip first portion 38 and a clip second portion 40. The clip first portion 38 extends roughly parallel to the front face 18 and rear face 34 and in a preferred embodiment of the invention is a further extension of the rear face 34. The clip second portion 40 is relatively resilient and flexible with respect to the remainder of the housing 12 and has at its terminus a rounded tip 42. The tip 42 is angled slightly so as to extend somewhat rearwardly from the remainder of the clip second portion 40. The clip second portion has an interior surface 44 and an exterior surface 46. The interior surface 44 is positioned adjacent to base 50 of housing 12 while exterior surface 46 faces outwardly from the housing.

Figure 3:
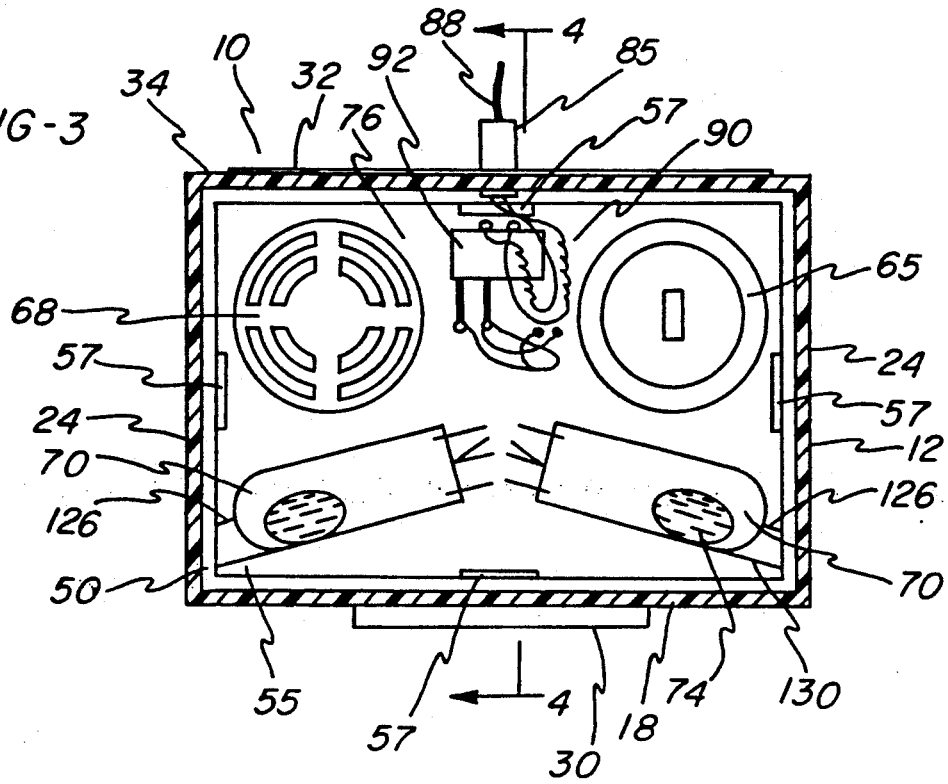
FIG. 3 is a horizontal sectional view taken along 3—3 of FIG. 2.

As can be seen in a comparison of FIGS. 3 and 4, the golf aid 10 of this invention comprises a circuit board 55. The circuit board 55 is preferably held in place in the housing by a plurality of circuit board retainers 57 which are shown as being angled or wedge shaped, and which are resilient with respect to the sides 24, front face 18 and rear face 34 of the housing. The circuit board may be placed into the housing and pressed downwardly so as to deflect the circuit board retainers momentarily. The circuit board retainers spring back into the position shown in FIGS. 3 and 4 once the circuit board 55 has cleared them. The circuit board retainers 57 are shown as having a circuit board retainer first end 58 which end is directly adjacent to the housing components and a circuit board retainer second end 59 which is shown as being directly adjacent and in connect with circuit board 55.

There is also shown in FIG. 4 a plurality of circuit board supports 62 which serve to space the circuit board 55 from the base 50. Each circuit board support 62 is comprised of a circuit board support first end 63 which is adjacent and preferably in contact with circuit board 55, as well as a circuit board support second end 64 which is directly adjacent to and in contact with the base 50.

Figure 5:
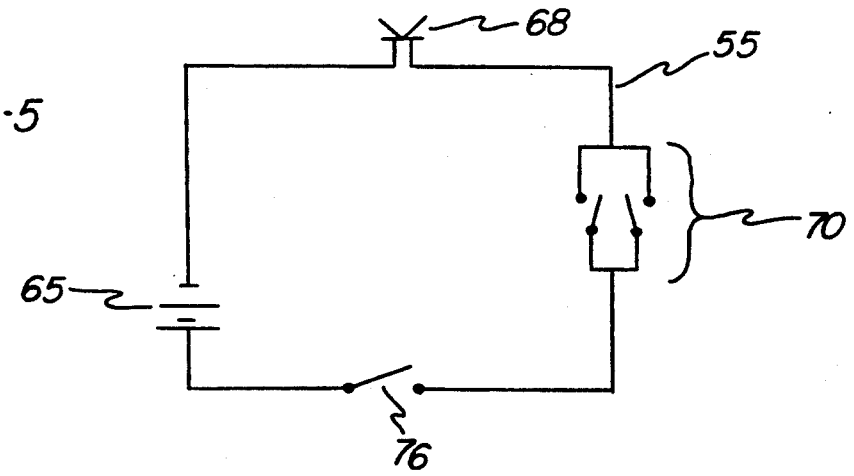
FIG. 5 is a schematic of the circuitry of the golf swing training apparatus of this invention.

The golf training apparatus of this invention is shown in FIGS. 3, 4, and 5 as comprising a battery 65, preferably in the range of 1.5 to 3 volts, a buzzer, which is preferably of the same voltage as the battery, a pair of mercury switches 70 having switch electrodes 72 and mercury 74, and an on/off switch. The on/off switch 76 preferably is coupled to the circuit board by means of on/off switch wiring 78, which wiring is secured to the on/off switch electrodes 80. The battery used in this invention is of the type commonly found in current calculators and some watches. The mercury switches are of the small mercury switch type used in electronics and available through companies such as Microswitch and Allied Electronics. Each of the components is preferably secured to the circuit board through known means, such as by solder.

The on/off switch 76 of this invention preferably includes a removable portion 85. This removable portion 85 comprises the switch mechanism. Remote wiring 90 approximately 10" in length is associated with the on/off switch 76 and is used to secure the removable portion of the switch 85 to the stationary portion of the switch 92. The stationary portion of the switch preferably comprises the on/off switch electrodes 80 and is fixedly secured within housing 12. Meanwhile, the removable portion of switch 85 projects through the rear face 34 and in the preferred embodiment of the invention, as shown in FIG. 6 may be viewed as an integral part of the entire housing unit.

Figure 6:
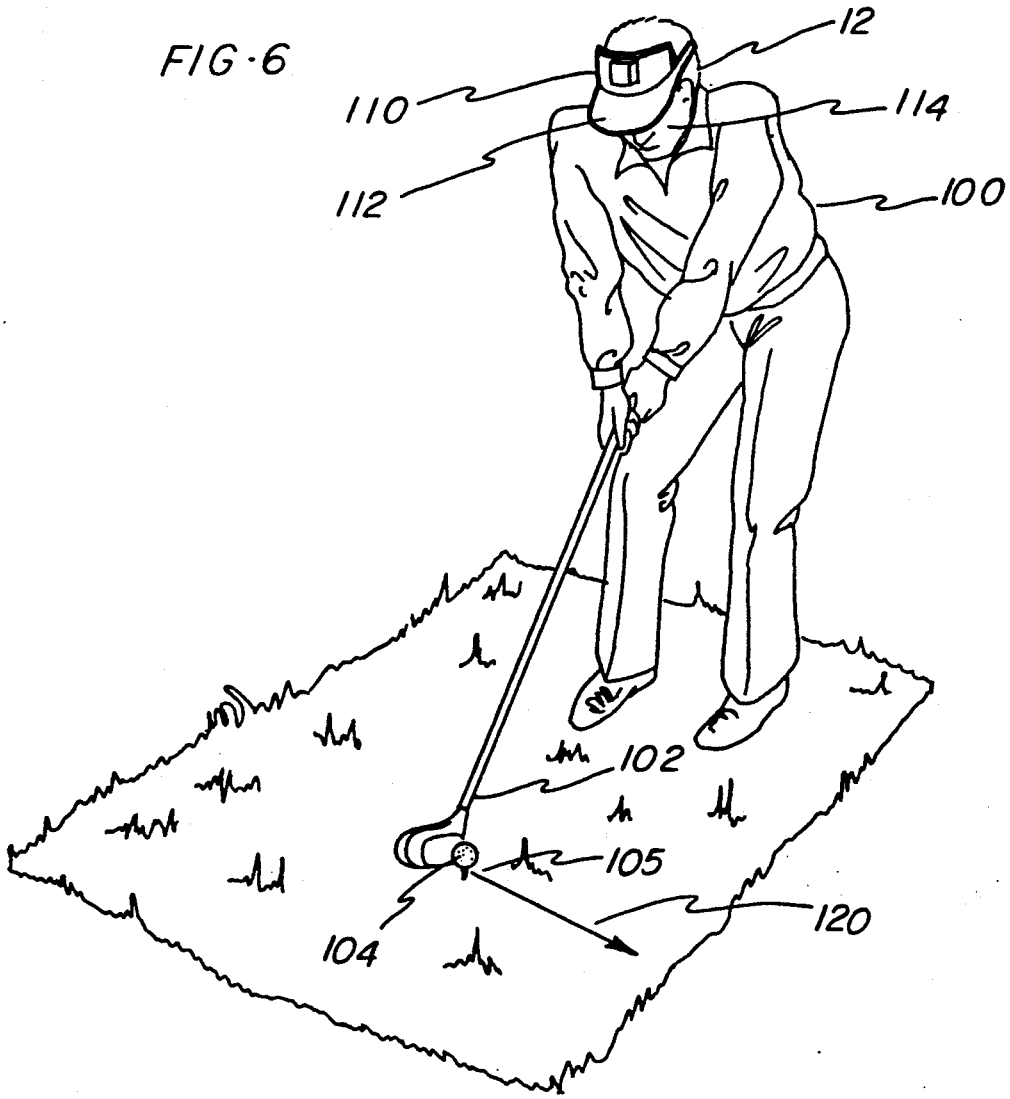
FIG. 6 is a perspective view of the golf swing training apparatus in use in the preferred operative embodiment.

In the operative embodiment of this invention as shown in FIG. 6, a golfer 100 having golf club 102 is shown about to strike ball 104 from atop a tee 105. Secured to the visor 110 of the golfer, preferably at the top of the front surface, is the golf aid of this invention. In this embodiment of the invention, the removable portion of the switch 85 is secured in the housing 12 similar to the views shown in FIGS. 3 and 4.

Figure 7:
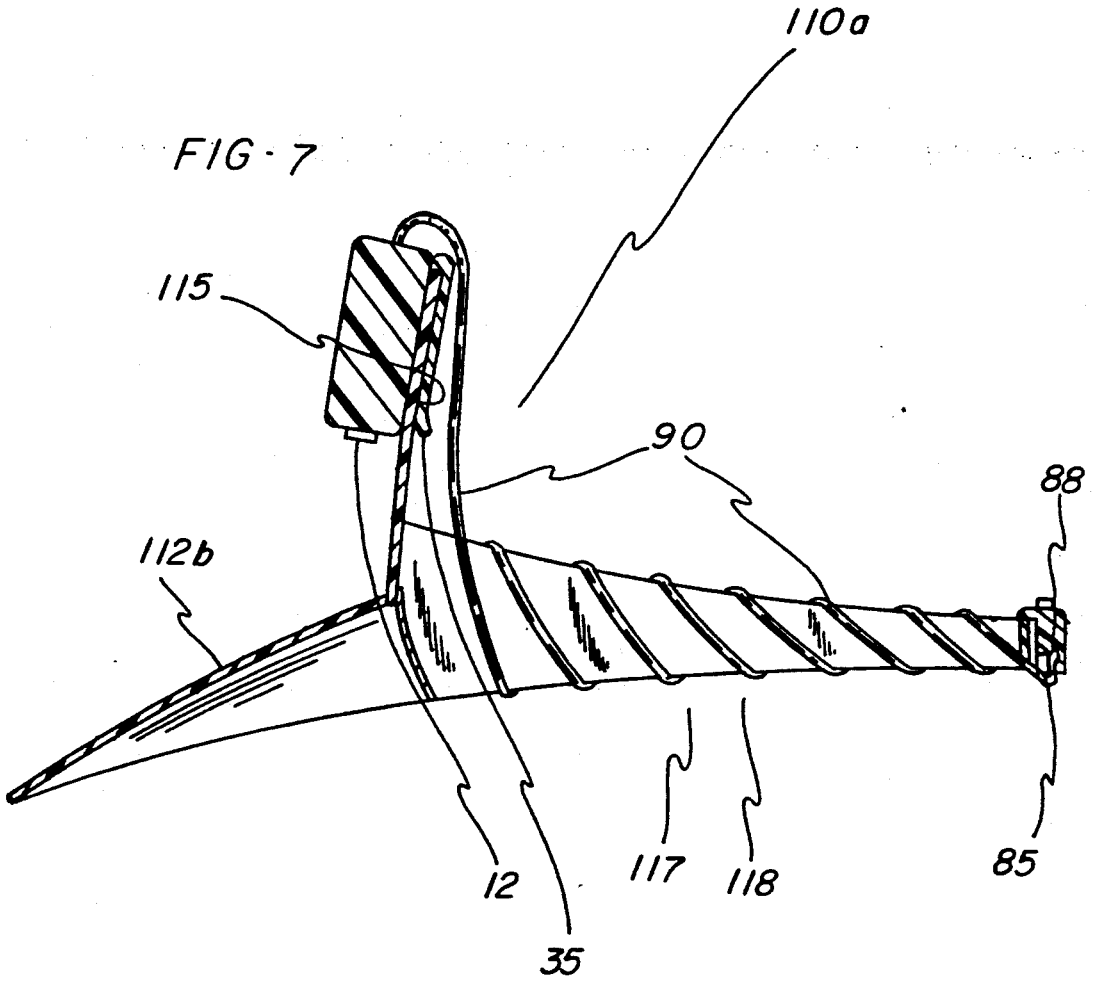
FIG. 7 is a vertical sectional view of a modified embodiment of the invention.

An alternative embodiment of the invention is shown in FIG. 7, wherein the golf aid 10 is secured by means of the clip 35 to a hat 110*b* along the inside hat surface 115, preferably the inside of the hat's front. The removable portion of the switch 85 is detached from its rest position as shown in FIGS. 3 and 4, at the lower rear outside edge of the hat, with the remote wiring 90 extending along the lower edge 117 of the hat 110*b* with its visor 112*b* preferably in the area of the head band 118. In fact it may be desirable to wrap the head band 118 with the remote wiring 90. The actual switch mechanism 88 may then be positioned near the lower edge of the hat 110*b* as shown, and in fact can hang downwardly from the head band 118.

In actual use of the invention, the head 114 of golfer 100 wears headgear utilizing either the preferred or alternative embodiment of the invention. As the golfer seeks to swing club 102 so as to hit ball 104 in the straight line direction 120 the absence of head movement results in the mercury switches 70 remaining open as shown in FIGS. 3 and 5. Should undesirable head tilt occur, the mercury effectively slides down one or the other of the mercury switches 70 and makes contact with the switch electrodes 72, thereby closing the circuit and activating the audible buzzer 68.

As shown in FIG. 3, the mercury switches 70 may be installed in a first position 125, such that they are parallel to first axis 126. In this position, the head 114 may be tilted throughout a range of approximately 7° to 35° before the mercury 74 closes the mercury switches 70. The approximate 7° tilt is believed desirable for more experienced golfers. For less experienced golfers, or for golfers who desire a little bit more freedom of head movement, the mercury switches 70 may be positioned along a second axis 130, which second axis 130 permits approximately a tilt of 35°. Although the preferred embodiment of the invention includes axes angled at 7° and 35° relative to the front face 12, it is possible that the range could extend from between 5° and 45° relative to the front face of the housing 12.

The golf swing training apparatus disclosed in accordance with this invention creates a device which is extremely lightweight and easy to use, and effective in controlling head movement. The unit maybe easily installed in operative position on a hat so as to be visible or practically undetectable. The invention may be utilized both in practice and in actual rounds of golf if desired.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A golf swing training apparatus for use in practicing proper head movement comprising in combination, headgear having a visor, and a housing, said housing having a closed top and a bottom, said housing having a clip member extending therefrom, said clip secured to said headgear, a circuit board, a buzzer, a battery, an on-off switch, and a pair of mercury switches, said mercury switches being so oriented in said housing that when said headgear is worn by a golfer and undesirable head tilt occurs during a golf swing, the mercury slides within one or the other of said switches and makes contact with the switch electrodes thereby closing the circuit and activating said buzzer.

2. The apparatus according to claim 1 wherein said on-off switch is extensible from said apparatus by a predetermined length of wiring.

3. The apparatus according to claim 1 wherein said housing has a front face, said pair of mercury switches angled between 5 and 45 degrees relative to said front face.

4. The apparatus according to claim 3 wherein said pair of mercury switches is angled between 7 and 35 degrees relative to said front face.

5. A golf swing training apparatus for use in practicing proper head movement comprising in combination, headgear having an interior surface wall and a lower edge, and a housing, said housing having a closed top and a bottom, said housing having a clip member extending therefrom, said clip secured to said interior surface wall, a circuit board, a buzzer, a battery, an on-off switch, a pair of mercury switches, said on-off switch being extensible from said apparatus by a predetermined length of wiring, said switch being secured near the lower edge of said headgear, said mercury switches being so oriented in said housing that when said headgear is worn by a golfer and undesirable head tilt occurs during a golf swing, the mercury slides within one or the other of said switches and makes contact with the switch electrodes thereby closing the circuit and activating said buzzer.

6. The apparatus according to claim 5 wherein said housing has a front face, said pair of mercury switches angled between 5 and 45 degrees relative to said front face.

7. The apparatus according to claim 6 wherein said pair of mercury switches is angled between 7 and 35 degrees relative to said front face.

* * * * *